US006493969B2

(12) United States Patent
Devos

(10) Patent No.: US 6,493,969 B2
(45) Date of Patent: Dec. 17, 2002

(54) DESKTOP INFORMATION CARRIER

(75) Inventor: Birgitte Devos, Berchem (BE)

(73) Assignee: Drukkerij Stockmans, naamloze vennootschap, Merksem (BE)

( * ) Notice: Subject to any disclaimer, the term of this patent is extended or adjusted under 35 U.S.C. 154(b) by 0 days.

(21) Appl. No.: 09/754,362

(22) Filed: Jan. 5, 2001

(65) Prior Publication Data

US 2002/0088151 A1 Jul. 11, 2002

(51) Int. Cl.[7] ..... G09D 3/04

(52) U.S. Cl. ..... 40/120; 40/119; 40/530; 283/2; 281/33; 248/459

(58) Field of Search ..... 40/119, 120, 530; 283/2; 248/459; 281/33

(56) References Cited

U.S. PATENT DOCUMENTS 2,208,213 A * 7/1940 Ericson ..... 283/2
2,328,645 A * 9/1943 Panzetta ..... 283/2
3,620,552 A * 11/1971 Woodcock ..... 281/33
3,704,037 A * 11/1972 Glassberg ..... 293/128
5,715,618 A * 2/1998 Whang ..... 40/119
5,784,814 A * 7/1998 Capehart ..... 40/120

FOREIGN PATENT DOCUMENTS

GB 553 478 5/1943

* cited by examiner

*Primary Examiner*—Cassandra H. Davis
(74) *Attorney, Agent, or Firm*—Bacon & Thomas, PLLC

(57) ABSTRACT

The invention relates to a desktop information carrier which comprises a support (1) of foldable material with a bottom part (3) and two walls adjoining thereto and converging towards the top, namely, a front wall (4) and a rear wall (5), and comprises a number of pages (2). One of the walls (4) has a lip (4A) at its upper extremity, and the pages (2) are exclusively attached to the upper extremity of the other wall (5), and in such a manner that, in between two locations, over a distance larger than the largest width of the lip (4A), they are loose from this wall (5). In usage condition, the aforementioned lip (4A) protrudes between said wall (5) and at least one page (2) which then is situated on the wall (4) with the lip (4A).

9 Claims, 2 Drawing Sheets

Fig. 1
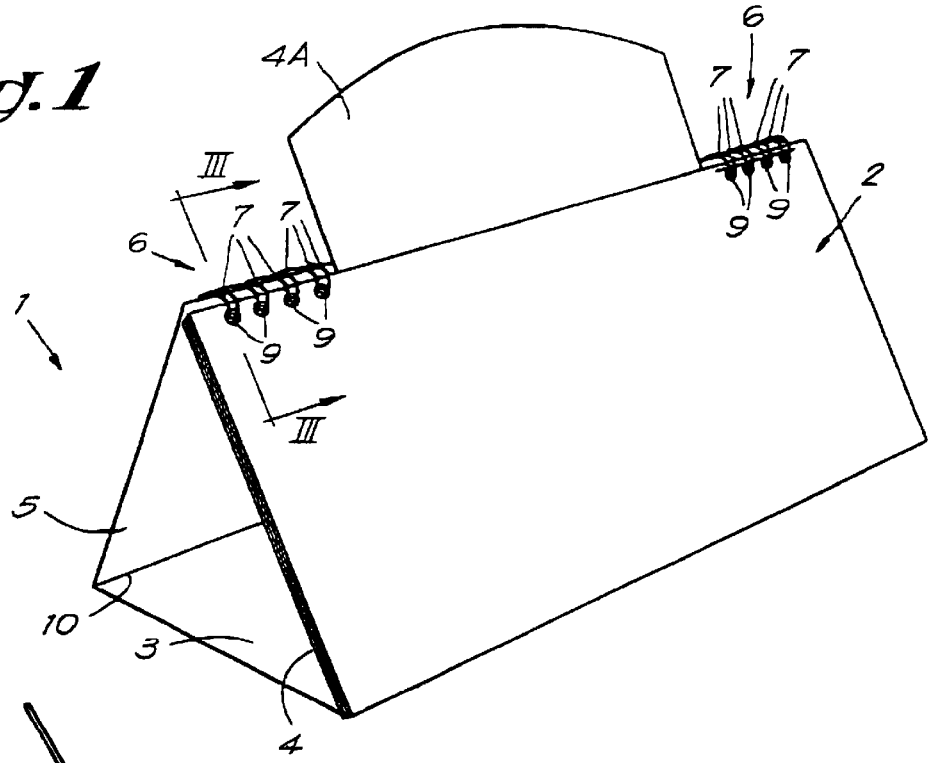
Fig. 2
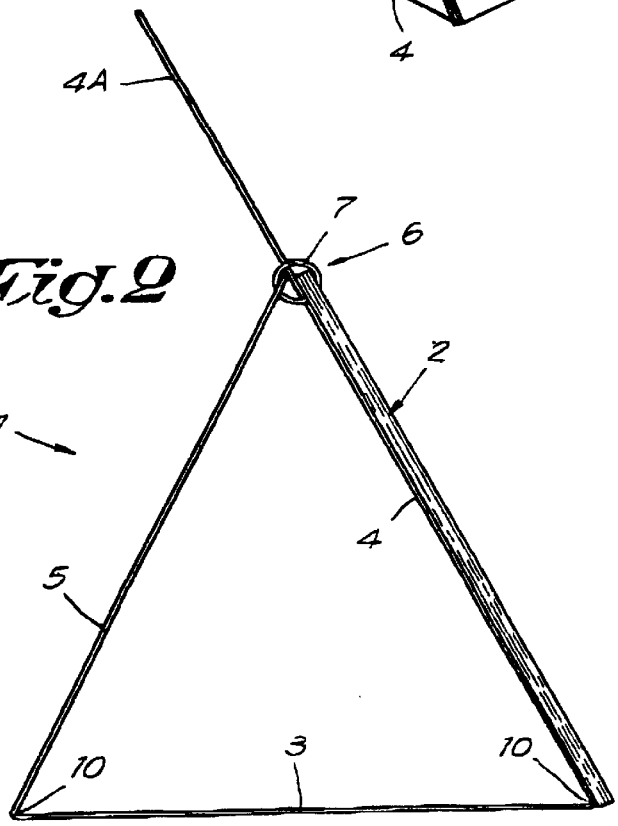
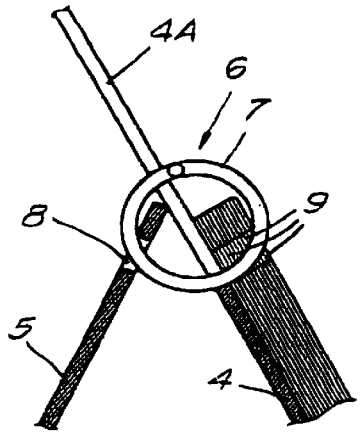
Fig. 3

DESKTOP INFORMATION CARRIER

BACKGROUND OF THE INVENTION

1. Field of the Invention

This invention relates to a desktop information carrier which comprises a unitary support of foldable material, mostly of cardboard, having a bottom part and two wall portions adjoining thereto, namely, a front wall and a rear wall, and which comprises a number of pages attached to at least one of the walls, whereby, in usage condition, the front wall and the rear wall are converging from the bottom part on.

2. Discussion of the Related Art

Such desktop information carriers are, for example, desk calendars, thus, calendars which, contrary to the calendars suspended on a wall, are placed or a table,a desk or similar.

Known desk calendars consist of a folded rectangular piece of cardboard, the free extremities of which are fixed to each other over their entire length by means of spiral wire or wire bent to rings which is provided through openings in the extremities. By means of these rings or this wire, the calendar pages, too, are attached.

As a result of the fact that, after folding, the extremities of the piece of cardboard and the paces have to be attached to each other simultaneously, the manufacturing of these known desk calendars is rather complicated.

The extremities of the piece of cardboard are fixedly attached to each other, and afterwards it is no longer possible for the user to enfold the calendar without damaging it.

Furthermore, the extremities of the piece of cardboard which are fixed to each other, have to be straight, such that a special design of the desk calendars practically is excluded. In the known desk calendars, the walls, which the calendar pages are situated, are rectangular.

SUMMARY OF THE INVENTION

The present invention has an object a desktop information carrier which does not show the aforementioned disadvantages and is of a simple construction, offers a high design variability and can be unfolded again.

According to the invention, this aim is achieved in that one of the walls, at its upper extremity, shows at least one lip and in that the pages are fixed exclusively to the upper extremity of the other wall, and in such a manner that they are attached to this upper extremity only locally and that, in between two locations, over a distance larger than the largest width of the lip, they are loose from this wall, whereby, in usage condition, the aforementioned lip, there where the pages are loose from the last-mentioned wall, protrudes between this wall and at least one page which then is situated on the wall with the lip.

Thus, the two walls are not fixed to each other, as a result of which manufacturing is easy and, by pulling the lip from one wall away from in between the pages and the other wall, the desktop information carrier at any time can be unfolded to a flat unit which Wakes little space for storing or transport.

The lip can be given different shapes. As the lip, in mounted condition of the desktop information carrier, protrudes at the top, this shape, of course, will catch the eye.

The pages can be attached to the one wall by means of bent wire.

BRIEF DESCRIPTION OF THE DRAWINGS

With the intention of better showing the characteristics of the invention, hereafter, as an example without any limitative character, a preferred form of embodiment of a desktop information carrier according to the invention described, with reference to the accompanying drawings wherein:

FIG. 1 represents a view in perspective of a desktop information carrier, more particular a desk calendar according to the invention, in usage condition;

FIG. 2 represents a lateral view of the table calendar from FIG. 1;

FIG. 3 represents a cross-section according to line III—III in. FIG. 1, drawn at a larger scale;

DESCRIPTION OF THE PREFERRED EMBODIMENT

Figure 4:
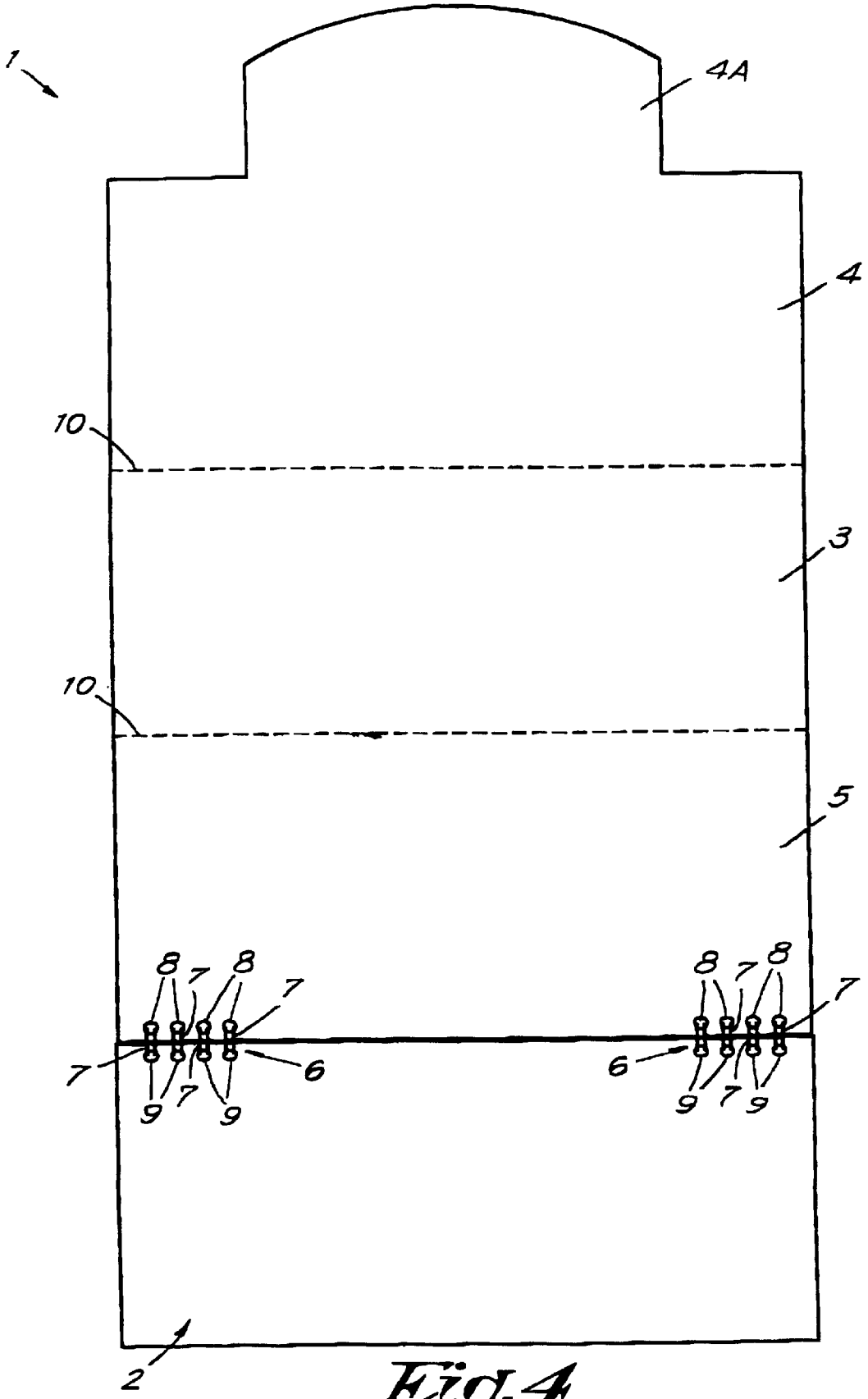
FIG. 4 represents a view of the desk calendar from the preceding figures, however, in unfolded condition.

The desk calendar represented in FIGS. 1 and 2 consists of a support 1, formed by a unitary piece of cardboard, and of a number of calendar pages 2, for example, one for every month, an extra front page and possibly a rear page.

This calendar is in usage condition, which means that the piece of cardboard of the support 1 is folded such that it shows a rectangular bottom part 3 and two wall portions adjoining thereto and standing inclined thereupon namely, a front wall 4 and a rear wall 5 converging towards the top, whereby the front wall 4, at its free extremity, has an upward-protruding lip 4A in the center.

The calendar pages 2 are fixed to the other extremity of the piece of cardboard and, therefore, at the free extremity or upper extremity of the rear wall 5.

It is important that the calendar pages 2 are not fixed over the entire length of the upper extremity of the rear wall a, but exclusively over a small distance starting from the two extremities of the upper edge, this is from the lateral edges of the rear wall 5. In between, and therefore over a large part which is symmetrically in respect to the middle, the calendar pages 2 are loose from the rear wall The distance over which the calendar pages 2 are loose from the rear wall 5, is larger or equal to the largest width of the lip 4A, measured parallel to the bottom part 3, and this lip 4A, in fact, protrudes upward between said rear wall 5 and at least a rubber of the calendar pages 2.

Thus, the last-mentioned calendar pages 2 are situated on the Front side of the front wall. The portions of the upper edge of the front wall 4 which are situated next to the lip 4A are held by the connections 6 between these calendar pages 2 and the rear wall 5.

In the represented example, two such connections 6 are present, respectively one between the lip 4A and each of the lateral edges of the rear wail 5.

These connections 6 consist of a wire folded in such a manner that it forms springy rings 7 which can be pulled open. Each of these rings 7 protrudes through an opening 6 in the rear wall 5 and opposite openings 9 in each of the calendar pages 2, as, above all, is clearly visible in FIG. 4 in which the desk calendar is represented in unfolded condition.

As is also visible in said FIG. 4, in consideration of folding, the piece of cardboard of which the support 1 is made, is provided with grooves 10, for example, by indentations, perforations or other weakened portions.

Said piece of cardboard is punched out in the desired shape, whereby the lip 4A can take different forms, the grooves 10 are provided and, alongside the edge which is opposed to the edge provided with the lip 4A, the openings 8 are provided.

Before, in between or after said processing steps, the piece of cardboard is printed.

The calendar pages 2 are cut to size and printed and provided with openings 9. Package per package, by means of connections 6, they are connected to the afore-mentioned piece of cardboard, which takes place before the piece of cardboard is folded and which, therefore, is rather simple.

Subsequently, the desk calendar can be shipped or commercialized in not yet folded condition. The user only has to fold the piece of cardboard according to the grooves 10 and put the lip 4A between the rear wall 5 and the package of calendar pages 2, while letting this package drop around the connections 6 onto the front side of the front wall 4.

Possibly, the piece of cardboard can already be folded according to one of the grooves 10 in order to form a more compact unit.

Indeed, it is possible to ship or to commercialize the desk calendar in folded condition. To this aim, the bottom part 3 temporarily has to be folded, such that an additional groove has to be provided in the center of this bottom part 3 and in the longitudinal direction thereof. In usage condition, the bottom part 3 can be flat or still a little bit folded.

If a calendar page 2 is no longer necessary, it can be torn off from the connections 6, whereby the openings in this calendar page 2 can form the tear-off line. Possibly, a separate tear-off line can be present.

Instead of tearing off the calendar page 2, it can also be turned around connections 6 towards the rear against the rear wall 5, whereby the lip 4A has to be drawn downward temporarily.

The calendar pages 2 do not necessarily have to connected to the rear wall 5 in the above-described manner. For example, the calendar pages 2 may be glued to the rear wall 5, more particularly to that side thereof which, after the calendar has been formed, is directed towards the front The afore-mentioned lip 4A can be given different shapes which, for example, are adapted to the print on the support and/or the calendar pages. As this lip 4A protrudes at the top, this shape is very eye-catching such that this lip 4A is particularly suitable for carrying advertisements.

The front wall 4 is not fixedly attached to he rear wall 5, such that, by pulling the lip 4A off, the front wall 4 and the rear wall 5 can be unfastened from each other again.

In fact, the calendar pages 2 hold the front wall 4 against the rear wall 5. In order to avoid that, at the end of the year, when most of the calendar pages 2 are no longer situated on the from wall 4, the support 1 becomes less stable, a stable extra calendar page 2, for example, made of cardboard, can be fixed on the support 1 as a lowermost calendar page 2.

The information printed on the pages does not necessarily always have to be related to the date. Some, or, in certain forms of embodiments, even all pages car carry other information, such as, for example, advertisements, tables of charges, timetables or similar. The desktop information carrier therefore does not necessarily have to be a desk calendar, and the paces not necessarily calendar pages.

The invention is in no way limited to the form of embodiment described heretofore, on the contrary may such desktop information carrier be realized in different variants without leaving the scope of the invention.

I claim:

1. A desktop information carrier that includes a plurality of pages and a unitary support of a foldable material, said support including a bottom portion and first and second wall portions each adjoining said bottom portion;

said first and second wall portions having bottom edges hinged along said bottom portion to permit convergence of top edges of said first and second wall portions towards one another;

said first wall portion having a lip extending from said top edge thereof;

said plurality of pages hingedly affixed to said second wall portion along the top edge thereof, only said second wall portion of said support having a series of apertures cooperating with corresponding apertures defined along the top edge of said plurality of pages to thereby permit coupling of said support with said plurality of pages;

wherein said first and second wall portions are configured such that said lip protrudes between said plurality of pages and said second wall portion, said plurality of pages resting against said first wall portion and at least one page of said plurality of pages arranged to be positioned to rest against the lip.

2. The desktop information carrier of claim 1 wherein the foldable material is cardboard.

3. The desktop information carrier of claim 1 wherein wire is inserted through and operable within each of said apertures of said second wall portion and said plurality of pages so as to couple said second wall with said plurality of pages.

4. The desktop information carrier of claim 3 wherein said apertures of said second wall portion and said plurality of pages are divided into two sections disposed respectively in opposite end regions along the top edges thereof.

5. The desktop information carrier of claim 1 wherein the second wall portion is a rear wall and the first wall portion is a front wail.

6. The desktop information carrier of claim 1 wherein a first groove is disposed between the bottom edge of the first wall portion and the bottom portion, and a second grooves disposed between the bottom edge of the second wall portion and the bottom portion.

7. The desktop information carrier of claim 6 wherein the bottom portion includes a middle groove longitudinally and centrally located thereon.

8. The desktop information carrier of claim 1 wherein at least one of the plurality of pages is a calendar page.

9. The desktop information carrier of claim 1 wherein the lip is centrally located along the top edge of the first wall portion.

* * * * *